US009954266B2

(12) United States Patent
Volobuev et al.

(10) Patent No.: US 9,954,266 B2
(45) Date of Patent: Apr. 24, 2018

(54) COMMUNICATION DEVICES

(71) Applicant: Molex, LLC, Lisle, IL (US)

(72) Inventors: Nikolay Volobuev, Montreal (CA); Xiaoma Jiang, Suzhou (CN); Wenzhe Ye, Suzhou (CN)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/334,638

(22) Filed: Oct. 26, 2016

(65) Prior Publication Data

US 2017/0133735 A1 May 11, 2017

(30) Foreign Application Priority Data

Oct. 30, 2015 (CN) ..... 2015 1 0728057

(51) Int. Cl.
*H01P 1/387* (2006.01)
*H01P 5/02* (2006.01)
*H01P 3/02* (2006.01)

(52) U.S. Cl.
CPC ..... *H01P 5/028* (2013.01); *H01P 1/387* (2013.01); *H01P 3/026* (2013.01)

(58) Field of Classification Search
CPC ..... H01P 1/387; H01P 1/38
USPC ..... 333/1.1, 24.2
See application file for complete search history.

(56) References Cited

U.S. PATENT DOCUMENTS 3,448,409 A * 6/1969 Moose ..... H01P 1/2135 333/1.1
3,538,459 A * 11/1970 Knerr ..... H01P 1/387 333/1.1
2003/0112089 A1* 6/2003 Jun ..... H01P 1/387 333/24.2
2010/0117754 A1* 5/2010 Yamamoto ..... H01P 1/387 333/1.1

* cited by examiner

*Primary Examiner* — Stephen E Jones
(74) *Attorney, Agent, or Firm* — Jeffrey K. Jacobs

(57) ABSTRACT

Communication device comprising a stripline circulator and at least a coupling piece. The stripline circulator comprises: magnetic assemblies comprising a first magnetic assembly and a second magnetic assembly, the first magnetic assembly and the second magnetic assembly are opposite to each other so as to generate a magnetic field; and a conductive jointing piece positioned between the first magnetic assembly and the second magnetic assembly, the conductive jointing piece comprises a center conductor which is positioned within outer peripheral edges of the magnetic assemblies and positioned in the magnetic field and at least three line connecting arms which extend outwardly from the center conductor. Each coupling piece comprising a first coupling portion positioned within the outer peripheral edges of the magnetic assemblies and positioned in the magnetic field, the first coupling portion is positioned in a space between the first magnetic assembly and the second magnetic assembly, the first coupling portion and one corresponding line connecting arm are opposite to each other so as to generate a coupling action.

22 Claims, 12 Drawing Sheets

COMMUNICATION DEVICES

RELATED APPLICATIONS

This application claims priority to Chinese Application No. 201510728057.8, filed Oct. 30, 2015, which is incorporated herein by reference in its entirety.

TECHNICAL FIELD

The present disclosure relates to a field of a communication device, and more specifically relate to an integral communication device integrating a coupler and a circulator.

BACKGROUND ART

This section introduces aspects that may help facilitate a better understanding of the inventions. Accordingly, the statements of this section are to be read in this light and are not to be understood as admissions about what is prior art or what is not prior art.

Currently, a combined device composed of a coupler and a circulator is usually used in the communication technology. The circulator is a multi-port device in which transmission of electromagnetic waves can only be unidirectionally circulated, taking a three-port (①port, ②port and ③port) circulator as an example, signals can only be transmitted along a forward direction, that is ①port→②port→③port→①port, the transmission of the signals along a reverse direction is isolated. In modern radar systems and multichannel microwave communication systems, a device with unidirectional circulation performance is used. For example, a circulator is usually used as a duplexer in a radar system in which a transceiver device shares one antenna. In the multichannel microwave communication system, the circulator may be used to isolate signals having different frequencies.

The principle of the circulator still lies in anisotropic characteristics of the ferrite material under a bias magnetic field. Microwave structures are divided into a microstrip type, a waveguide type, a stripline type and a coaxial type, and a microstrip three-port circulator is most used, the microstrip three-port circulator uses a ferrite material as a dielectric, makes a conductive strip structure on the ferrite material, will have a circulation performance under a applied constant magnetic field. If the direction of the bias magnetic field is changed, the direction of circulation will be changed.

However, currently, power loss easily occurs on the combined device composed of the coupler and the circulator, and because transmission lines are used to match the coupler and the circulator, unnecessary loss, such as loss at total reflection and insertion loss, and additional cost are generated. Therefore, in order to eliminate these unnecessary losses and cost, it would be desirable for the coupler and the circulator to be unified and integrated.

In view of the above problems, inventors of the present disclosure provide an integral communication device integrating a coupler and a circulator.

SUMMARY OF THE PRESENT DISCLOSURE

An object of the present disclosure is to provide a communication device, which can integrate a coupler and a circulator in space, and reduce the loss at total reflection and the insertion loss under the matching status.

In one aspect of the present disclosure, the present disclosure provides a communication device comprising a stripline circulator and at least a coupling piece. The stripline circulator comprises: magnetic assemblies comprising a first magnetic assembly and a second magnetic assembly, the first magnetic assembly and the second magnetic assembly are opposite to each other so as to generate a magnetic field; and a conductive jointing piece positioned between the first magnetic assembly and the second magnetic assembly, the conductive jointing piece comprises a center conductor which is positioned within outer peripheral edges of the magnetic assemblies and positioned in the magnetic field and at least three line connecting arms which extend outwardly from the center conductor. Each coupling piece comprising a first coupling portion positioned within the outer peripheral edges of the magnetic assemblies and positioned in the magnetic field, the first coupling portion is positioned in a space between the first magnetic assembly and the second magnetic assembly, the first coupling portion and one corresponding line connecting arm are opposite to each other so as to generate a coupling action.

In an embodiment, the first coupling portion is parallel to the opposite line connecting arm.

In an embodiment, the first coupling portion and the conductive jointing piece are positioned in the same plane between the first magnetic assembly and the second magnetic assembly.

In an embodiment, each coupling piece further comprises a reciprocating fold line segment positioned in the magnetic field to increase impedance of the coupling piece, the reciprocating fold line segment is positioned in the space between the first magnetic assembly and the second magnetic assembly.

In an embodiment, a degree of coupling between the first coupling portion and the opposite line connecting arm is from 10 dB to 30 dB.

In an embodiment, the stripline circulator further comprises: a shell, the shell has a side wall and a bottom portion so as to form a receiving space in the shell to receive the magnetic assemblies, the conductive jointing piece and the first coupling portion of the coupling piece; and a cover, the cover is connected to the shell so as to cover the receiving space.

In an embodiment, the side wall of the shell has several openings, the line connecting arms of the conductive jointing piece each extend out of the side wall from one corresponding opening.

In an embodiment, the coupling piece has a first end and a second end, the first end and the second end of the coupling piece and the opposite line connecting arm together extend out of the side wall from one corresponding opening.

In an embodiment, each line connecting arm comprises: an inductance line, the inductance line extends outwardly from the center conductor, the first coupling portion is coupled with the inductance line of the opposite line connecting arm; and a contacting sheet, the contacting sheet has a first end and a second end, the first end of the contacting sheet is connected to the inductance line, the second end of the contacting sheet extends out of the side wall from the corresponding opening.

In an embodiment, each line connecting arm further comprises at least a capacitance portion, the capacitance portion is connected to the first end of the contacting sheet.

In an embodiment, the capacitance portion latches onto an inside of the corresponding opening.

In an embodiment, the first end of the coupling piece is perpendicular to the contacting sheet of the opposite line connecting arm, the second end of the coupling piece is parallel to the contacting sheet of the opposite line connecting arm.

In an embodiment, the coupling piece further comprises a second coupling portion, the second coupling portion is positioned outside the outer peripheral edges of the magnetic assemblies, the second coupling portion and the contacting sheet generate a coupling action.

In an embodiment, the first magnetic assembly comprises a first permanent magnet, a first heat resistant interlayer and a first ferrite dielectric which are sequentially stacked along a direction toward the conductive jointing piece; and the second magnetic assembly comprises a second ferrite dielectric, a second heat resistant interlayer and a second permanent magnet which are sequentially stacked along a direction away from the conductive jointing piece; the first ferrite dielectric and the second ferrite dielectric clamp the coupling piece and the conductive jointing piece.

In an embodiment, the first heat resistant interlayer and the second heat resistant interlayer each are an iron sheet.

In an embodiment, the first heat resistant interlayer and the second heat resistant interlayer each are a soft steel sheet.

In an embodiment, the first heat resistant interlayer and the second heat resistant interlayer each are a soft magnetic disk.

In an embodiment, at least one opening is provided with at least one resistor, the resistor is connected to the coupling piece or the line connecting arm extending outwardly from the corresponding opening.

In an embodiment, the first end of the coupling piece is connected to the resistor, the coupling piece and the opposite line connecting arm form a directional coupler.

In an embodiment, the stripline circulator is an isolator, one line connecting arm of the conductive jointing piece is connected to the resistor.

In an embodiment, the stripline circulator further comprises an anti-rotation positioning plate, the anti-rotation positioning plate is positioned between the cover and the second magnetic assembly, an outer periphery of the anti-rotation positioning plate is provided with several protrusions each having a different direction, the protrusions each are positioned and latched into one different opening of the side wall.

In an embodiment, the stripline circulator further comprises a third heat resistant interlayer, the third heat resistant interlayer is positioned between the anti-rotation positioning plate and the second magnetic assembly.

In an embodiment, the conductive jointing piece and the coupling piece each are a silver plated copper sheet.

In an embodiment, the conductive jointing piece has three line connecting arms, an angle between every two adjacent line connecting arms is 120°.

With the above technology, certain embodiments of the communication device of the present disclosure can integrate the coupler and the circulator in space, and reduce the loss at total reflection and the insertion loss under the matching status.

BRIEF DESCRIPTION OF THE DRAWINGS

Technology solutions of the present disclosure will be described in detail in combination with the accompanying figures and specific embodiments, so as to make features and advantages of the present disclosure more apparent. The present invention is illustrated by way of example and is not to be limited by the accompanying figures. Simplicity and clarity in both illustration and description are sought to effectively enable a person of skill in the art to make, use, and best practice the present invention in view of what is already known in the art. One of skill in the art will appreciate that various modifications and changes may be made to the specific embodiments described below without departing from the spirit and scope of the present invention. Thus, the specification and drawings are to be regarded as illustrative and exemplary rather than restrictive or all-encompassing, and all such modifications to the specific embodiments described below are intended to be included within the scope of the present invention.

DETAILED DESCRIPTION OF THE PREFERRED EMBODIMENTS

Figure 1:
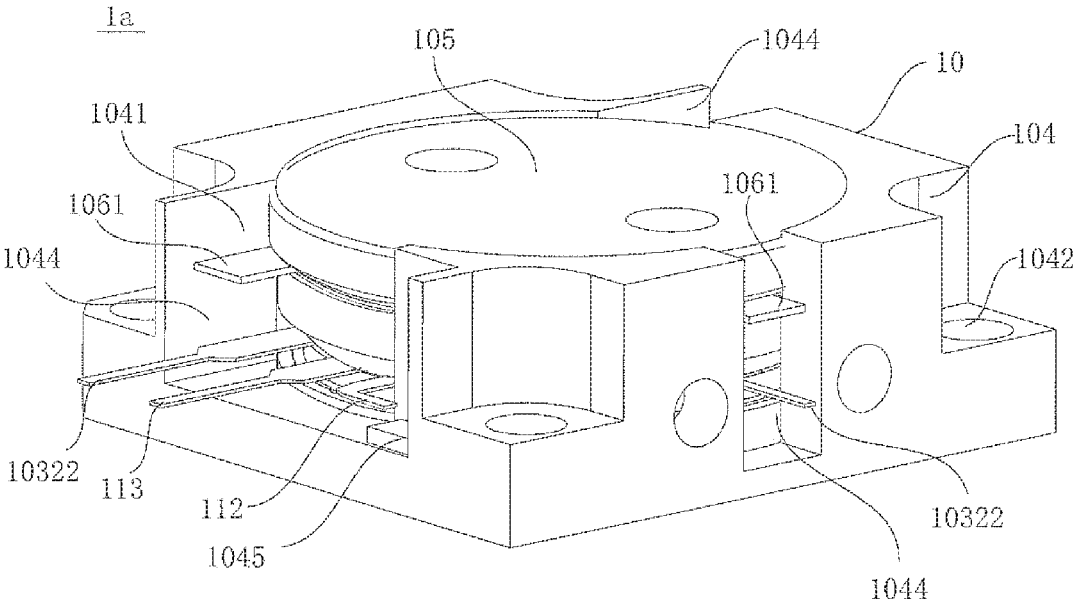
FIG. 1 is an assembled perspective view of a communication device of a first embodiment of the present disclosure.

Hereinafter, embodiments of the present disclosure will be described in detail. Although the present disclosure will be illustrated and described in combination with some specific embodiments, it should be noted that the present disclosure is not limited to these specific embodiments. Instead, modifications or equivalent substitutions made to the present disclosure are all included in the scope of the claims of the present disclosure.

In addition, in order to better explain the present disclosure, numerous specific details are disclosed in the following specific embodiments. It will be understood by those skilled in the art that the present disclosure may also be implemented without these specific details. In other embodiments, detailed descriptions of well-known structures and components to those skilled in the art are omitted in order to highlight the purpose of the present disclosure.

Now exemplary embodiments of the present disclosure will be described in detail with reference to the accompanying figures. Each exemplary embodiment of the present disclosure may only take a three-port stripline circulator as an example. However, the present disclosure may be implemented in various embodiments, and shall not be interpreted to limit the present disclosure to the exemplary embodiments as illustrated herein. More exactly, the exemplary embodiments are provided to make the present disclosure full and complete, and fully pass the scope of the present disclosure to those skilled in the art. In the accompanying figures, shapes and dimensions may be exaggerated for sake of clarity, and the same reference numeral is used throughout to indicate the same or similar component.

Figure 2:
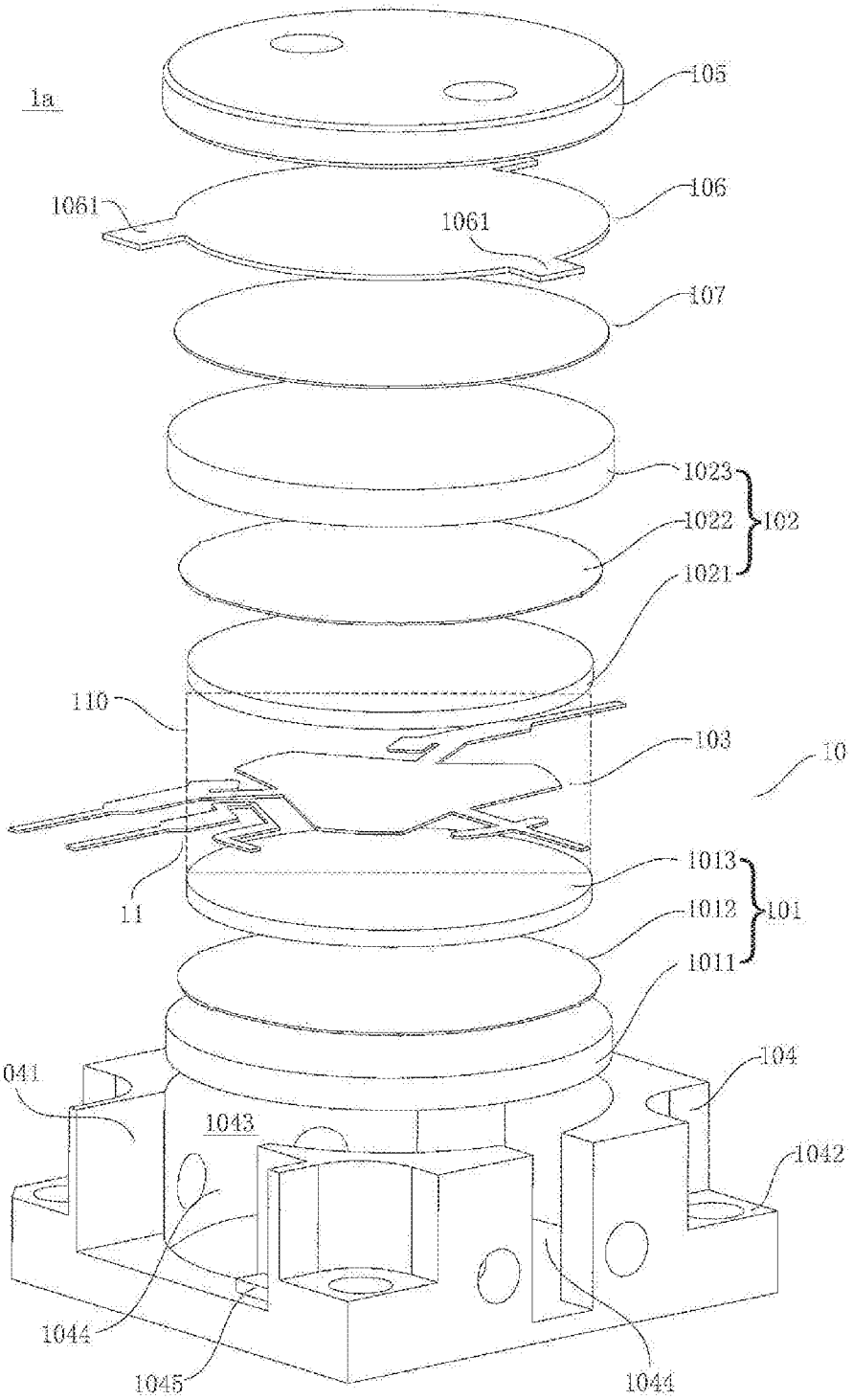
FIG. 2 is an exploded perspective view of the communication device of the first embodiment of the present disclosure.

FIG. 1 is an assembled perspective view of a communication device of a first embodiment of the present disclosure. FIG. 2 is an exploded perspective view of the communication device of the first embodiment of the present disclosure. As shown in FIG. 1 and FIG. 2, a communication device 1*a* of a first embodiment of the present disclosure comprises: a stripline circulator 10 and a coupling piece 11 integrated in the stripline circulator 10. In the present embodiment, one circulator only makes one coupling piece integrated therein, however, the present disclosure is not limited to this.

The stripline circulator 10 comprises a shell 104 and a cover 105. The shell 104 has a side wall 1041, which is circular annular, and a bottom portion 1042, which is rectangular, so as to form a receiving space 1043, which is cylindrical, in the shell 104. The cover 105 is detachably screwed with the shell 104 via a screw thread so as to cover the receiving space 1043.

The side wall 1041 of the shell 104 has three openings 1044, however, the present disclosure is not limited to this. One of the three openings 1044 is provided with one resistor 1045, a resistance of the resistor 1045 may be 50 ohm which is an industry-standard resistance, however, the present disclosure is not limited to this.

The stripline circulator 10 further comprises magnetic assemblies and a conductive jointing piece 103 which are received in the receiving space 1043. The magnetic assemblies comprise a first magnetic assembly 101 and a second magnetic assembly 102, the first magnetic assembly 101 and the second magnetic assembly 102 are opposite to each other so as to generate a magnetic field.

In the present embodiment, the first magnetic assembly 101 comprises a first permanent magnet 1011, a first heat resistant interlayer 1012 and a first ferrite dielectric 1013 which are sequentially stacked along a direction toward the conductive jointing piece 103. The second magnetic assembly 102 comprises a second ferrite dielectric 1021, a second heat resistant interlayer 1022 and a second permanent magnet 1023 which are sequentially stacked along a direction away from the conductive jointing piece 103. The first ferrite dielectric 1013 and the second ferrite dielectric 1021 clamp the coupling piece 11 and the conductive jointing piece 103. Because the stripline circulator 10 reaches a very high temperature in operation, the first magnetic assembly 101 and the second magnetic assembly 102 in the stripline circulator 10 each are a heat-resisting material. Here, the first heat resistant interlayer 1012 and the second heat resistant interlayer 1022 each may be a heat-resisting and conductive metal material, such as an iron sheet, a soft steel sheet or a soft magnetic disk and the like, however, the present disclosure is not limited to this. The first magnetic assembly 101 and the second magnetic assembly 102 cooperate to generate a magnetic field in the receiving space 1043. A strength of the magnetic field can be specifically changed by changing a thickness of the first heat resistant interlayer 1012 and a thickness of the second heat resistant interlayer 1022. The thickness of the first heat resistant interlayer 1012 and/or the thickness of the second heat resistant interlayer 1022 are thicker, the strength of the magnetic field is weaker; the thickness of the first heat resistant interlayer 1012 and/or the thickness of the second heat resistant interlayer 1022 are thinner, the strength of the magnetic field is stronger.

In addition, as one of alternative embodiments, when the cover 105 is rotated into the shell 104, in order to prevent the components in the receiving space 1043 (the first magnetic assembly 101, the second magnetic assembly 102, the conductive jointing piece 103 and the coupling piece 11) from being offset due to driving of the rotated cover 105, an anti-rotation positioning plate 106 is provided between the cover 105 and the second magnetic assembly 102. Three protrusions 1061 each having a different direction are provided at an outer periphery of the anti-rotation positioning plate 106, the three directions of the three protrusions 1061 are respectively matched with three directions of the three openings 1044 of the side wall 1041, therefore the three protrusions 1061 can be respectively positioned and latched into the three openings 1044 of the side wall 1041. When the cover 105 is rotated, the anti-rotation positioning plate 106 which cannot be rotated prevents the rotating moment of the cover 105 from being transferred downwardly, so as to ensure that the components in the receiving space 1043 will not be offset. Moreover, a third heat resistant interlayer 107 may further be provided between the anti-rotation positioning plate 106 and the second magnetic assembly 102, so as to further prevent the rotating moment of the cover 105 from being transferred downwardly.

Figure 3:
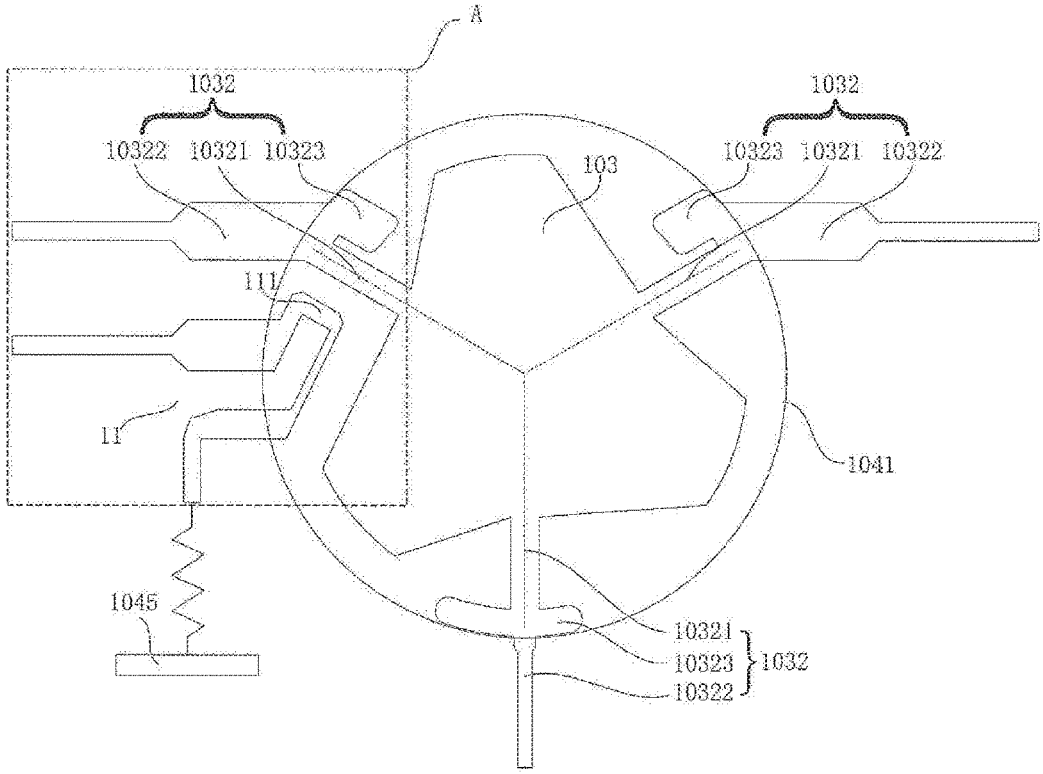
FIG. 3 is a structural schematic view of a coupling piece and a conductive jointing piece of the communication device of the first embodiment of the present disclosure.

The conductive jointing piece 103 is positioned between the first magnetic assembly 101 and the second magnetic assembly 102. FIG. 3 is a structural schematic view of a coupling piece and a conductive jointing piece of the communication device of the first embodiment of the present disclosure. As shown in FIG. 3, the conductive jointing piece 103 comprises a center conductor 1031 which is positioned within outer peripheral edges of the magnetic assemblies and positioned in the magnetic field and three line connecting arms 1032 which extend outwardly from the center conductor 1031.

In the present embodiment, the three line connecting arms 1032 are uniformly distributed on a circumferential direction, that is an angle between every two adjacent line connecting arms 1032 is 120°. The three line connecting arms 1032 of the conductive jointing piece 103 extend out of the side wall 1041 respectively from the three openings 1044. The number of the line connecting arms 1032 of the conductive jointing piece 103 is matched with the number of the openings 1044 of the side wall 1041.

Each line connecting arm 1032 comprises: an inductance line 10321, a contacting sheet 10322 and at least a capacitance portion 10323. The inductance line 10321 extends outwardly from the center conductor 1031, the inductance line 10321 is coupled with the first coupling portion 111. The contacting sheet 10322 has a first end and a second end, the first end of the contacting sheet 10322 is connected to the inductance line 10321, the second end of the contacting sheet 10322 extends out of the side wall 1041 from the corresponding opening 1044. For example: each line connecting arm 1032 may have one capacitance portion 10323 or two capacitance portions 10323 connected to the first end of the contacting sheet 10322. The capacitance portion 10323 cooperates with the contacting sheet 10322 in each line connecting arm 1032, and the capacitance portion 10323 and the contacting sheet 10322 are respectively latched onto insides of the opening 1044, so as to more precisely position the conductive jointing piece 103, and prevent movement of the conductive jointing piece 103. The conductive jointing piece 103 and the coupling piece 11 each are a silver plated copper sheet, however, the present disclosure is not limited to this.

Figure 4:
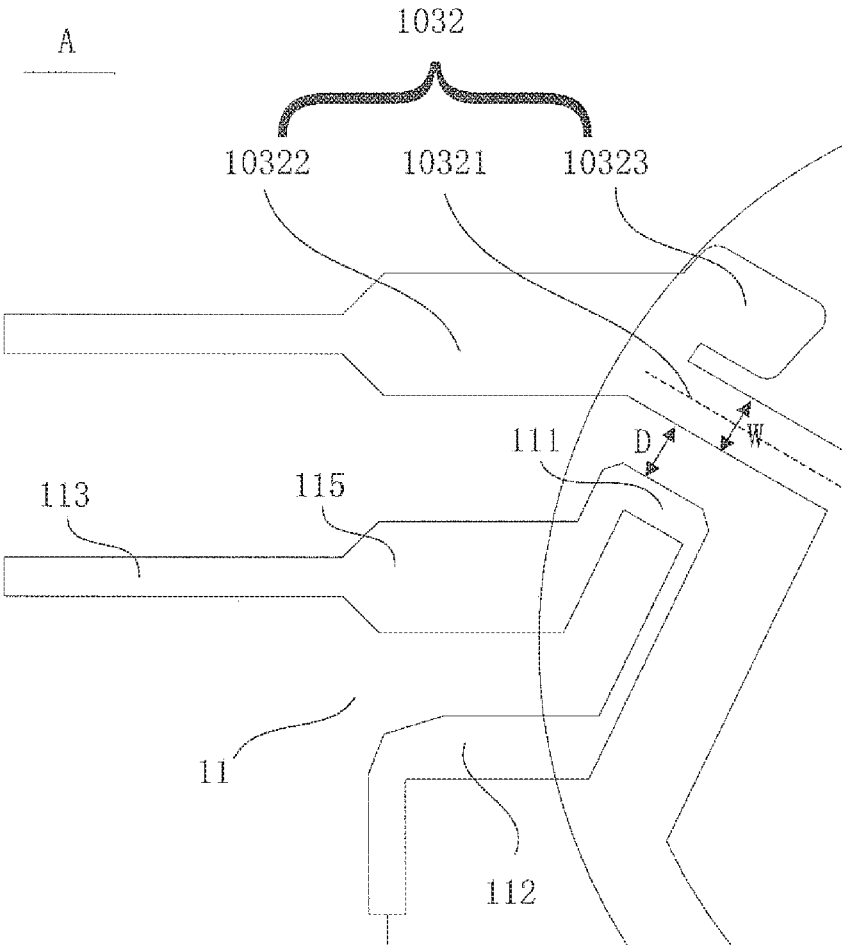
FIG. 4 is an enlarged view of a region A of FIG. 3.

FIG. 4 is an enlarged view of a region A of FIG. 3. As shown in FIG. 4, unlike the prior art, the coupling piece 11 comprises a first coupling portion 111 positioned in the magnetic field and within the outer peripheral edge of the magnetic assembly 101 and the outer peripheral edge of the magnetic assembly 102. The first coupling portion 111 of the present disclosure is positioned in a space 110 between the first magnetic assembly 101 and the second magnetic assembly 102, the first coupling portion 111 is opposite to the inductance line 10321 of one line connecting arm 1032, the first coupling portion 111 and the opposite inductance line 10321 of the one line connecting arm 1032 generate a coupling action under the magnetic field generated by the first magnetic assembly 101 and the second magnetic assembly 102. Therefore, by providing the coupling piece 11 in the magnetic field of the stripline circulator 10, not only a coupler can be formed in the stripline circulator 10, but also because of such an integral structure which is highly integrated, transmission lines matching the stripline circulator 10 and the coupler of the present disclosure are significantly simplified, the loss generated from the matching of the transmission lines is significantly reduced, and the loss at total reflection and the insertion loss under the matching status are also reduced.

The first coupling portion 111 may be close to and parallel to the opposite inductance line 10321, so as to obtain the best coupling effect, however, the present disclosure is not limited to this. The first coupling portion 111 may be also positioned near the opposite inductance line 10321 along a direction approximately parallel to the opposite inductance line 10321.

From the standpoint of space, the first coupling portion 111 and the conductive jointing piece 103 are positioned in the same plane between the first magnetic assembly 101 and the second magnetic assembly 102 (as shown in FIG. 3). Technology solutions obtained by adjusting a position relationship between the first coupling portion 111 of the coupling piece 11 and the conductive jointing piece 103 in the magnetic field on the basis of the present disclosure are also included in the scope of the present disclosure.

In the present disclosure, a degree of coupling between the first coupling portion 111 and the opposite line connecting arm 1032 is from 10 dB to 30 dB (decibel), the degree of coupling therebetween may be changed according to actual demands, and the present disclosure is not limited to this. The coupling effect between the first coupling portion 111 and the opposite inductance line 10321 is affected by many factors. For example, a straight-line distance D between the first coupling portion 111 and the opposite inductance line 10321, the straight-line distance D is smaller, the coupling effect is larger; the straight-line distance D is larger, the coupling effect is smaller. Or, the width W of the opposite inductance line 10321 (that is a width of a line body of the opposite inductance line 10321) is larger, the coupling effect is larger; the width W of the inductance line 10321 is smaller, the coupling effect is smaller. Technology solutions obtained by changing the above parameters on the basis of the present disclosure so as to strength the coupling effect are also included in the scope of the present disclosure.

Continuing with reference to FIG. 2 and FIG. 4, the coupling piece 11 has a first end 112 and a second end 113, the first end 112 and the second end 113 of the coupling piece 11 and the opposite line connecting arm 1032 together extend out of the side wall 1041 from the same opening 1044. Furthermore, the first end 112 of the coupling piece 11 is perpendicular to the opposite contacting sheet 10322, the second end 113 of the coupling piece 11 is parallel to the opposite contacting sheet 10322. The first end 112 of the coupling piece 11 extending outwardly from the opening 1044 is connected to the resistor 1045, so that the coupling piece 11 and the opposite line connecting arm 1032 (see FIG. 3) form an embedded type directional coupler. Moreover, during the assembling process, when the cover 105 is screwed tightly into the shell 104, the first end 112 of the coupling piece 11 will directly contact the resistor 1045 so as to ensure an electrical connection therebetween.

The coupling piece 11 further has a second coupling portion 115 mainly positioned outside the magnetic field, the second coupling portion 115 may be formed between the second end 113 and the first coupling portion 111 of the coupling piece 11. The second coupling portion 115 is positioned outside the outer peripheral edges of the magnetic assemblies 101, 102, the second coupling portion 115 is parallel to and close to the contacting sheet 10322, therefore the second coupling portion 115 and the contacting sheet 10322 generate a coupling action outside the magnetic field, so as to further enhance the whole coupling effect of the coupling piece 11. Of course, the coupling action generated by the first coupling portion 111 in the magnetic field is more than the coupling action generated by the second coupling portion 115 outside the magnetic field.

Figure 5:
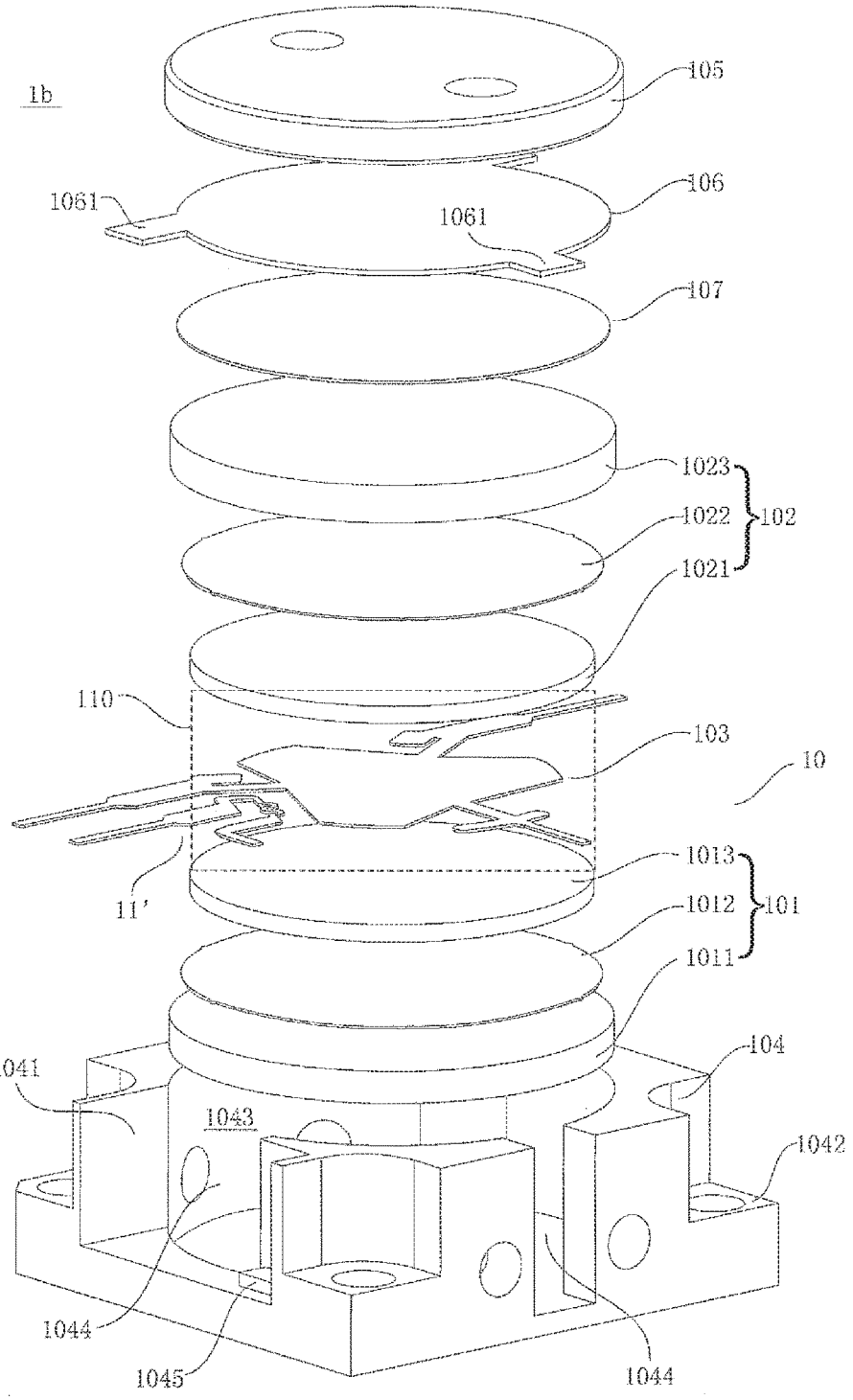
FIG. 5 is an exploded perspective view of a communication device of a second embodiment of the present disclosure.
Figure 6:
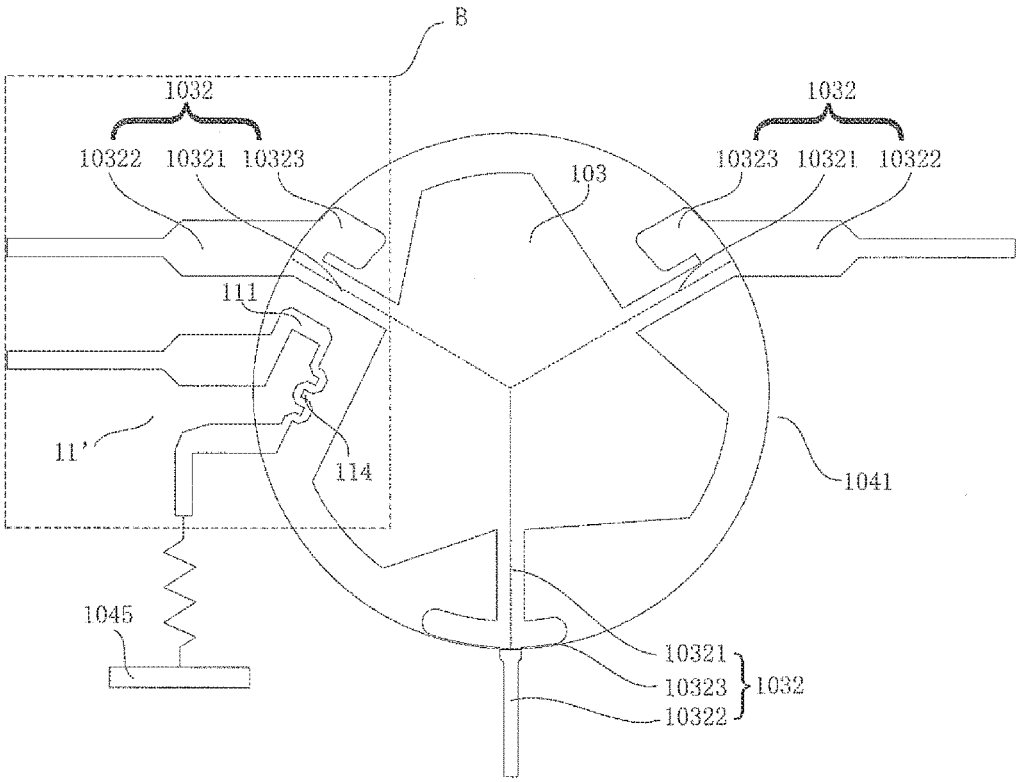
FIG. 6 is a structural schematic view of a coupling piece and a conductive jointing piece of the communication device of the second embodiment of the present disclosure.
Figure 7:
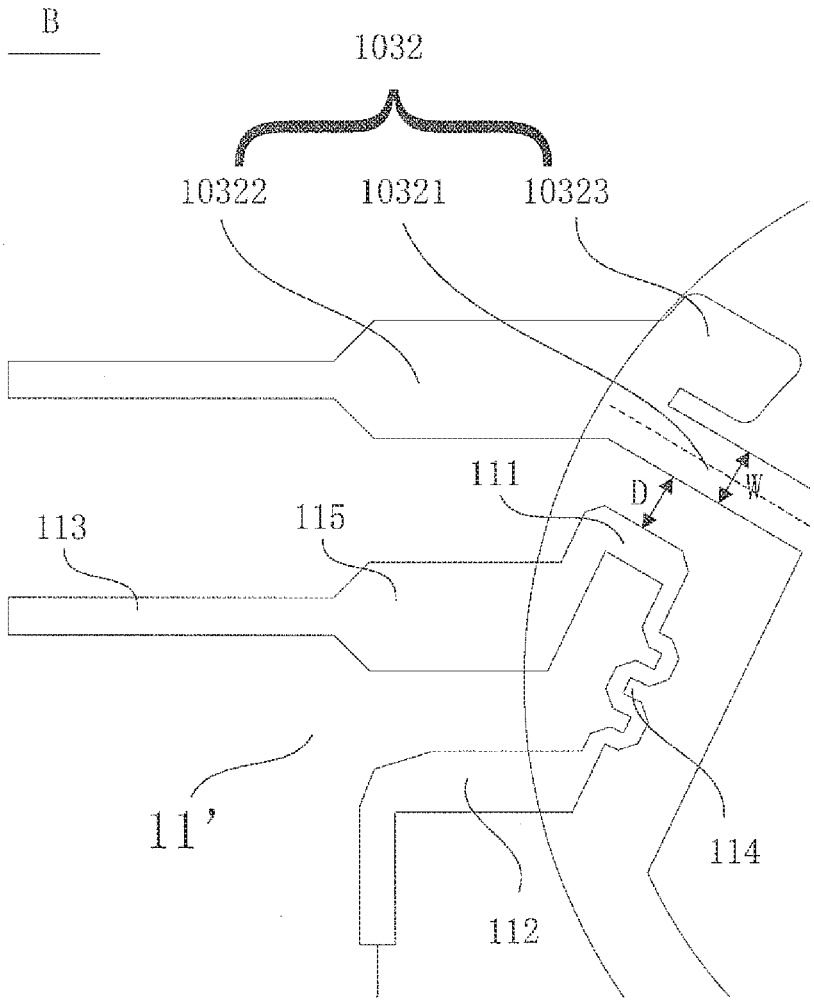
FIG. 7 is an enlarged view of a region B of FIG. 6.

FIG. 5 is an exploded perspective view of a communication device of a second embodiment of the present disclosure. FIG. 6 is a structural schematic view of a coupling piece and a conductive jointing piece of the communication device of the second embodiment of the present disclosure. FIG. 7 is an enlarged view of a region B of FIG. 6. As shown in FIG. 5 to FIG. 7, unlike the first embodiment, in the communication device 1*b* of the second embodiment of the present disclosure, the coupling piece 11' further comprises a reciprocating fold line segment 114 positioned in the magnetic field to increase an impedance of the coupling piece 11', the reciprocating fold line segment 114 is positioned in the space 110 between the first magnetic assembly 101 and the second magnetic assembly 102. By changing a length and a reciprocating pitch and the like of the reciprocating fold line segment 114, the impedance of the coupling piece 11' can be further changed, so as to enhance the coupling effect between the coupling piece 11' and the corresponding inductance line 10321. Other technical features are the same as those in FIG. 1 to FIG. 4, therefore the detailed explanation is omitted.

Figure 8:
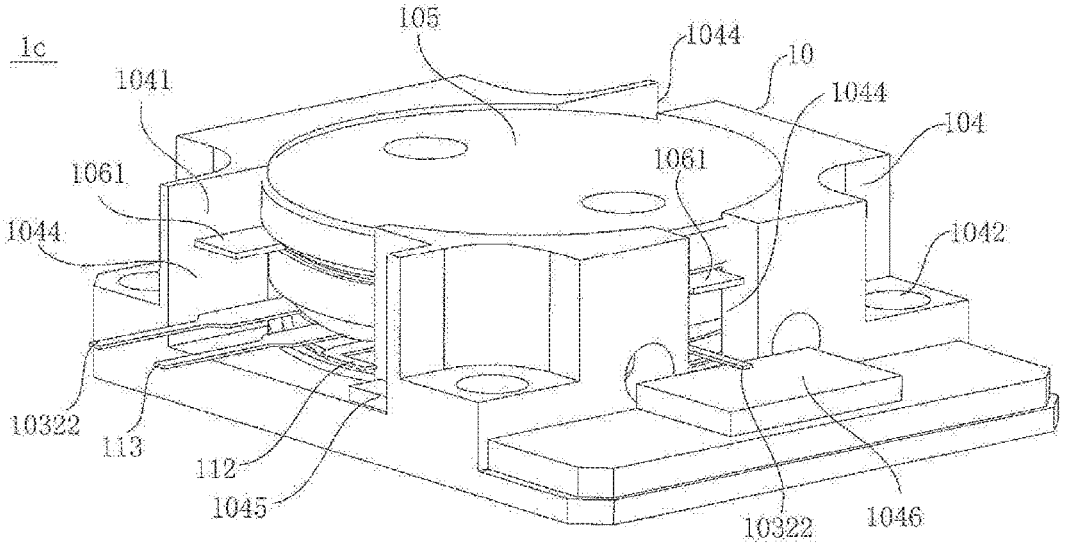
FIG. 8 is an assembled perspective view of a communication device of a third embodiment of the present disclosure.
Figure 9:
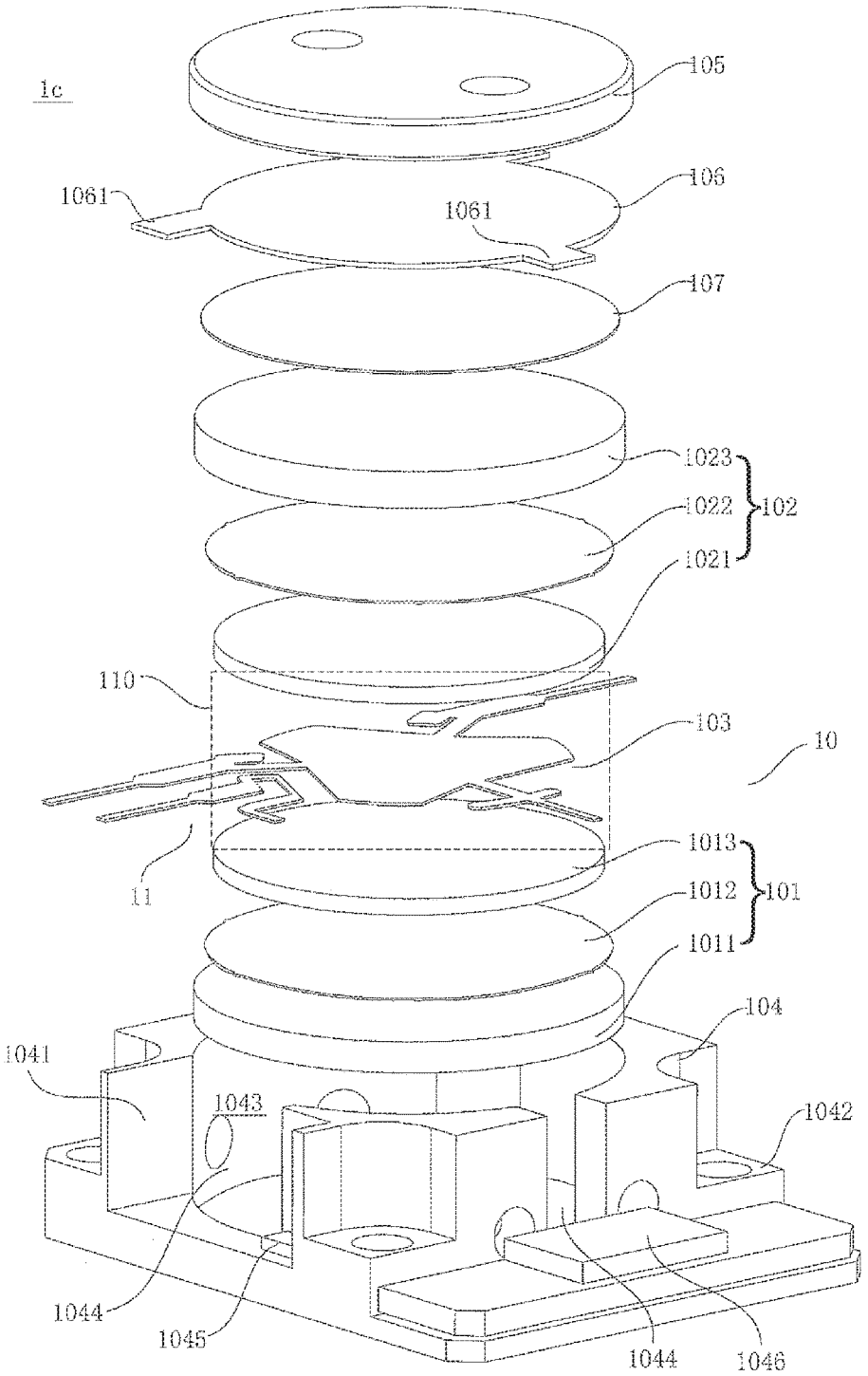
FIG. 9 is an exploded perspective view of the communication device of the third embodiment of the present disclosure.
Figure 10:
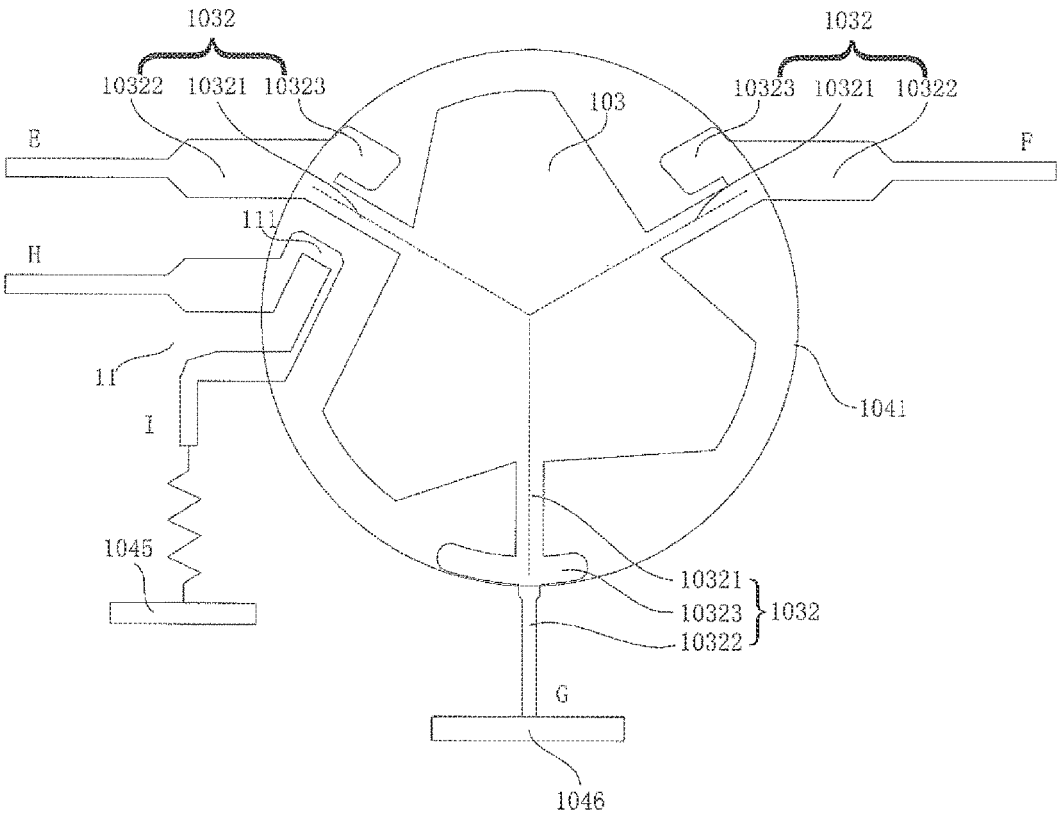
FIG. 10 is a structural schematic view of a coupling piece and a conductive jointing piece of the communication device of the third embodiment of the present disclosure.

FIG. 8 is an assembled perspective view of a communication device of a third embodiment of the present disclosure. FIG. 9 is an exploded perspective view of the communication device of the third embodiment of the present disclosure. FIG. 10 is a structural schematic view of a coupling piece and a conductive jointing piece of the communication device of the third embodiment of the present disclosure. As shown in FIG. 8 to FIG. 10, unlike the first embodiment, in the communication device 1*c* of the third embodiment of the present disclosure, the stripline circulator 10 is an isolator. The coupling piece 11 of the communication device 1*c* of the third embodiment is the same as the coupling piece 11 of the communication device 1*a* of the first embodiment. The coupling piece 11 and the stripline circulator 10 form a directional coupler, two of the three openings 1044 each are provided with a resistor, that is, besides the first end 112 of the coupling piece 11 is connected to one resistor 1045, one line connecting arm 1032 of the conductive jointing piece 103 may also be connected to another resistor 1046, thereby making the stripline circulator 10 form an isolator. Other technical characteristics are the same as those in FIG. 1 to FIG. 4, therefore the detailed explanation is omitted.

Figure 11:
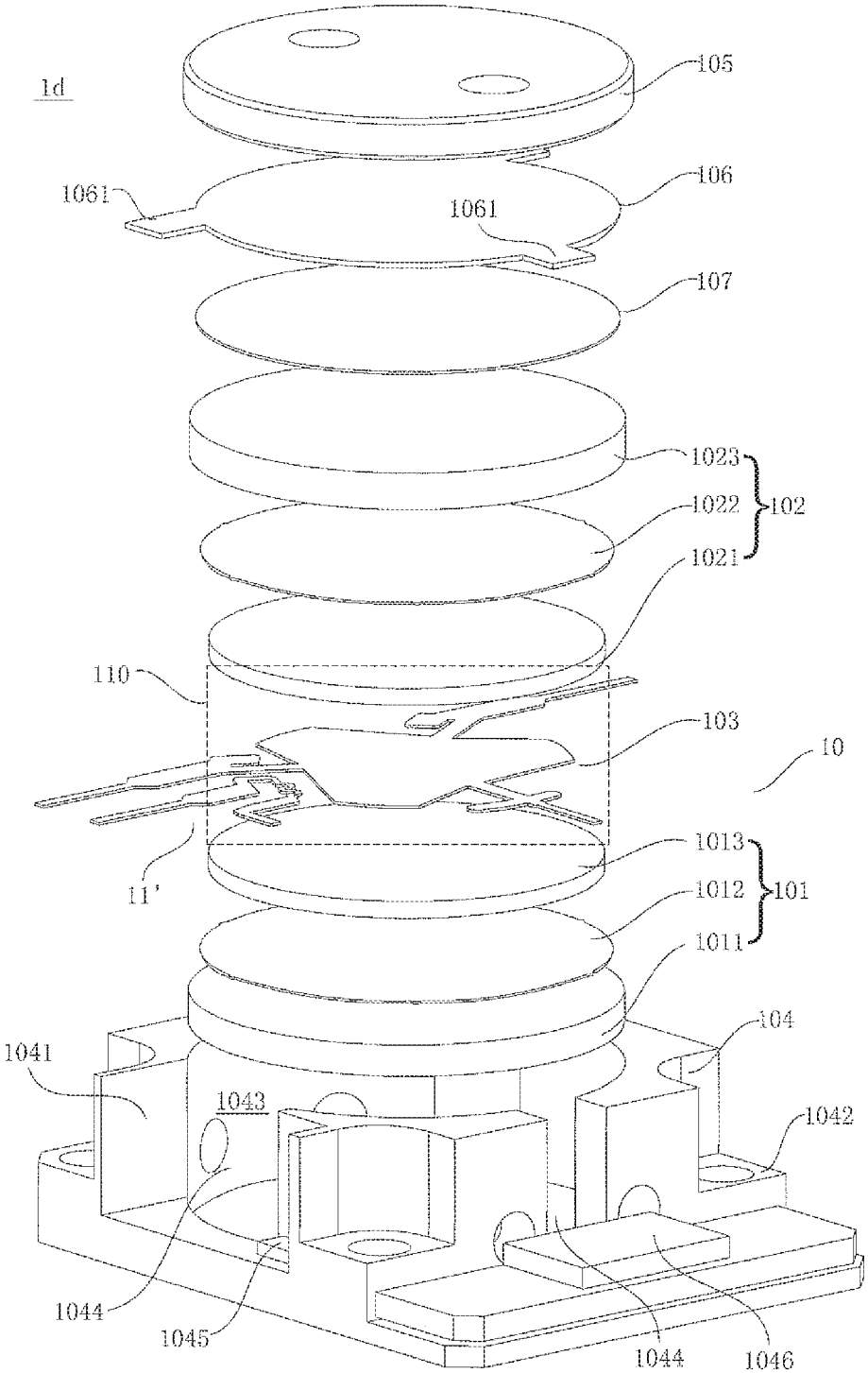
FIG. 11 is an exploded perspective view of a communication device of a fourth embodiment of the present disclosure.
Figure 12:
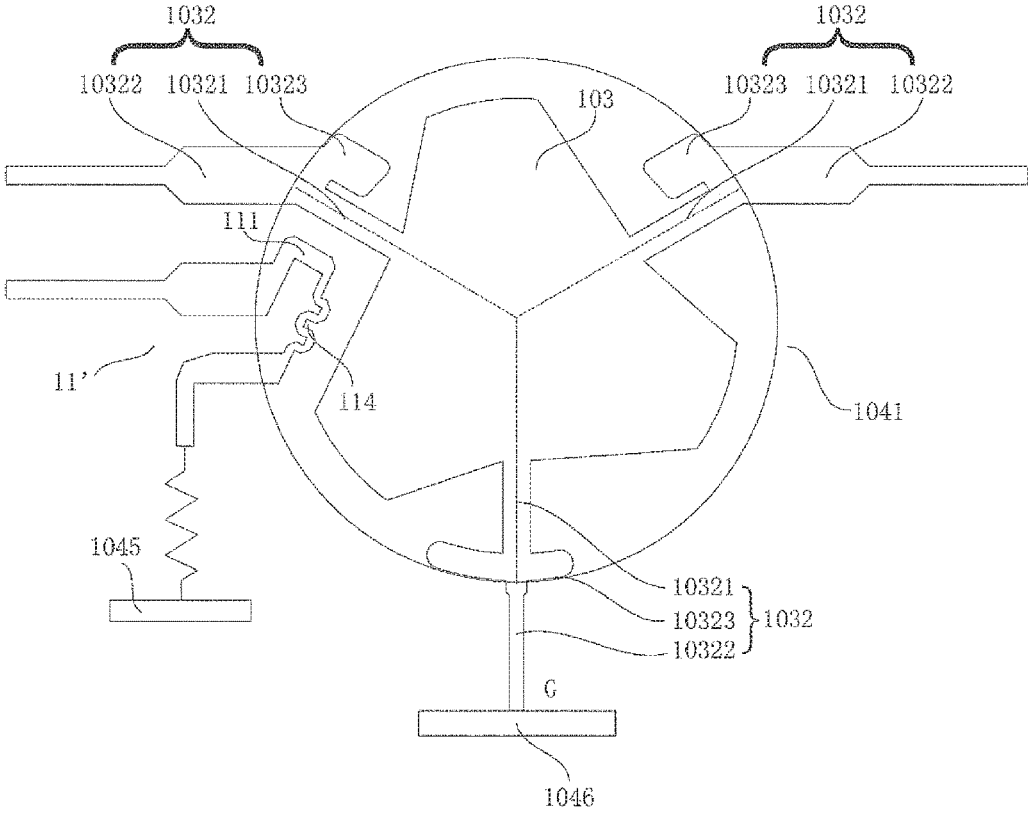
FIG. 12 is a structural schematic view of a coupling piece and a conductive jointing piece of the communication device of the fourth embodiment of the present disclosure.

FIG. 11 is an exploded perspective view of a communication device of a fourth embodiment of the present disclosure. FIG. 12 is a structural schematic view of a coupling piece and a conductive jointing piece of the communication device of the fourth embodiment of the present disclosure. As shown in FIG. 11 to FIG. 12, unlike the second embodiment, in the communication device 1*d* of the fourth embodiment of the present disclosure, the stripline circulator 10 is an isolator. The coupling piece 11' of the communication device 1*d* of the fourth embodiment is the same as the coupling piece 11' of the communication device 1*b* of the second embodiment. The coupling piece 11' and the stripline circulator 10 form a directional coupler, two of the three openings 1044 each are provided with a resistor, that is, besides the first end 112 of the coupling piece 11' is connected to one resistor 1045, one line connecting arm 1032 of the conductive jointing piece 103 may also be connected to another resistor 1046, thereby making the stripline circulator 10 form an isolator. Other technical characteristics are the same as those in FIG. 5 to FIG. 7, therefore the detailed explanation is omitted.

Continuing with reference to FIG. 10, in order to explain the operation principle of the communication device of the present disclosure, the three ends of the conductive jointing piece 103 are respectively indicated as an E end, a F end and a G end. The first end 112 of the coupling piece 11 is indicated as a H end, the second end 113 of the coupling piece 11 is indicated as an I end. That the degree of coupling between the coupling piece 11 and the conductive jointing piece 103 is 30 dB is taken as an example.

When a current of a power of 100 watts flows forward through the isolator, that is the current flows from the E end of the conductive jointing piece 103 though the F end of the conductive jointing piece 103, the first coupling portion 111 of the coupling piece 11 and the corresponding inductance line 10321 of the conductive jointing piece 103 are coupled, the H end of the coupling piece 11 obtains a power of about 0.1 watt, moreover, when the degree of coupling is 30 dB, the I end of the coupling piece 11 also obtains a power of about 0.1 watt. When the current passes through the E end and reaches the F end, a power of about 90 watts is substantially remained after a part of the power is absorbed by the material of the conductive jointing piece 103.

When the current reversely flows through the isolator, that is, the current flows from the F end of the conductive jointing piece 103 through the E end of the conductive jointing piece 103, because of the biasing function of the isolator, a current of a large part of the power flows to the G end of the conductive jointing piece 103 and this part of the power is absorbed by the resistor 1046 at the G end, a current of the other small part of the power flows to the E end and is coupled with the first coupling portion 111 of the coupling piece 11, if the H end and the I end of the coupling piece 11 each obtain a coupled current, the resistor 1045 at the I end will further absorb the corresponding power of the reverse flow current.

In conclusion, the communication device of the present disclosure can integrate the coupler and the circulator together in space, and reduce the loss at total reflection and the insertion loss when the coupler and the circulator are under the matching status.

What have been described above are only specific examples of the present disclosure, the protective scope of the present disclosure is not limited to that. In addition to the above embodiments, other embodiments of the present disclosure are also possible. Technology solutions obtained from equivalent replacements or equivalent variations are still included in the protective scope of the present disclosure.

Benefits, other advantages, and solutions to problems have been described herein with regard to specific embodiments of the present invention. However, the benefits, advantages, solutions to problems, and any element(s) that may cause or result in such benefits, advantages, or solutions, or cause such benefits, advantages, or solutions to become more pronounced are not to be construed as a critical, required, or essential feature or element of any or all the claims.

What is claimed is:

1. A communication device, comprising:

a stripline circulator comprising:

magnetic assemblies comprising a first magnetic assembly and a second magnetic assembly, the first magnetic assembly and the second magnetic assembly being opposite to each other so as to generate a magnetic field; and a conductive jointing piece positioned between the first magnetic assembly and the second magnetic assembly, the conductive jointing piece comprising a center conductor which is positioned within outer peripheral edges of the magnetic assemblies and positioned in the magnetic field and at least three line connecting arms which extend outwardly from the center conductor; and at least a coupling piece, each coupling piece comprising a first coupling portion positioned within the outer peripheral edges of the magnetic assemblies and positioned in the magnetic field, the first coupling portion being positioned in a space between the first magnetic assembly and the second magnetic assembly, the first coupling portion and one corresponding line connecting arm being opposite to each other so as to generate a coupling action.

2. The communication device of claim 1, wherein the first coupling portion is parallel to the opposite line connecting arm.

3. The communication device of claim 1, wherein the first coupling portion and the conductive jointing piece are positioned in the same plane between the first magnetic assembly and the second magnetic assembly.

4. The communication device of claim 1, wherein each coupling piece further comprises a reciprocating fold line segment positioned in the magnetic field to increase impedance of the coupling piece, the reciprocating fold line segment is positioned in the space between the first magnetic assembly and the second magnetic assembly.

5. The communication device of claim 1, wherein a degree of coupling between the first coupling portion and the opposite line connecting arm is from 10 dB to 30 dB.

6. The communication device of claim 1, wherein the conductive jointing piece and the coupling piece each are a silver plated copper sheet.

7. The communication device of claim 1, wherein the conductive jointing piece has three line connecting arms, an angle between every two adjacent line connecting arms is 120°.

8. The communication device of claim 1, wherein the first magnetic assembly comprises a first permanent magnet, a first heat resistant interlayer and a first ferrite dielectric which are sequentially stacked along a direction toward the conductive jointing piece; and the second magnetic assembly comprises a second ferrite dielectric, a second heat resistant interlayer and a second permanent magnet which are sequentially stacked along a direction away from the conductive jointing piece;

the first ferrite dielectric and the second ferrite dielectric clamp the coupling piece and the conductive jointing piece.

9. The communication device of claim 8, wherein the first heat resistant interlayer and the second heat resistant interlayer each are an iron sheet.

10. The communication device of claim 1, wherein the stripline circulator further comprises:

a shell, the shell has a side wall and a bottom portion so as to form a receiving space in the shell to receive the magnetic assemblies, the conductive jointing piece and the first coupling portion of the coupling piece; and a cover, the cover is connected to the shell so as to cover the receiving space.

11. The communication device of claim 10, wherein the side wall of the shell has several openings, the line connecting arms of the conductive jointing piece each extend out of the side wall from one corresponding opening.

12. The communication device of claim 11, wherein the stripline circulator further comprises an anti-rotation positioning plate, the anti-rotation positioning plate is positioned between the cover and the second magnetic assembly, an outer periphery of the anti-rotation positioning plate is provided with several protrusions each having a different direction, the protrusions each are positioned and latched into one different opening of the side wall.

13. The communication device of claim 12, wherein the stripline circulator further comprises a third heat resistant interlayer, the third heat resistant interlayer is positioned between the anti-rotation positioning plate and the second magnetic assembly.

14. The communication device of claim 11, wherein at least one opening is provided with at least one resistor, the resistor is connected to the coupling piece or the line connecting arm extending outwardly from the corresponding opening.

15. The communication device of claim 14, wherein the first end of the coupling piece is connected to the resistor, the coupling piece and the opposite line connecting arm form a directional coupler.

16. The communication device of claim 14, wherein the stripline circulator is an isolator, one line connecting arm of the conductive jointing piece is connected to the resistor.

17. The communication device of claim 11, wherein the coupling piece has a first end and a second end, the first end and the second end of the coupling piece and the opposite line connecting arm together extend out of the side wall from one corresponding opening.

18. The communication device of claim 17, wherein each line connecting arm comprises:

an inductance line, the inductance line extends outwardly from the center conductor, the first coupling portion is coupled with the inductance line of the opposite line connecting arm; and a contacting sheet, the contacting sheet has a first end and a second end, the first end of the contacting sheet is connected to the inductance line, the second end of the contacting sheet extends out of the side wall from the corresponding opening.

19. The communication device of claim 18, wherein each line connecting arm further comprises at least a capacitance portion, the capacitance portion is connected to the first end of the contacting sheet.

20. The communication device of claim 19, wherein the capacitance portion latches onto an inside of the corresponding opening.

21. The communication device of claim 20, wherein the first end of the coupling piece is perpendicular to the contacting sheet of the opposite line connecting arm, the second end of the coupling piece is parallel to the contacting sheet of the opposite line connecting arm.

22. The communication device of claim 21, wherein the coupling piece further comprises a second coupling portion, the second coupling portion is positioned outside the outer peripheral edges of the magnetic assemblies, the second coupling portion and the contacting sheet generate a coupling action.

* * * * *